US008515747B2

(12) United States Patent
Gao

(10) Patent No.: US 8,515,747 B2
(45) Date of Patent: Aug. 20, 2013

(54) SPECTRUM HARMONIC/NOISE SHARPNESS CONTROL

(75) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 690 days.

(21) Appl. No.: 12/554,675

(22) Filed: Sep. 4, 2009

(65) Prior Publication Data

US 2010/0063803 A1 Mar. 11, 2010

Related U.S. Application Data

(60) Provisional application No. 61/094,883, filed on Sep. 6, 2008.

(51) Int. Cl.
*G10L 19/14* (2006.01)

(52) U.S. Cl.
USPC ..... 704/234; 704/205; 704/207

(58) Field of Classification Search
USPC ..... 704/234, 207, 205
See application file for complete search history.

(56) References Cited

U.S. PATENT DOCUMENTS

| | | | |
|---|---|---|---|
| 5,828,996 | A | 10/1998 | Iijima et al. |
| 5,974,375 | A | 10/1999 | Aoyagi et al. |
| 6,018,706 | A | 1/2000 | Huang et al. |
| 6,507,814 | B1 | 1/2003 | Gao |
| 6,629,283 | B1 | 9/2003 | Toyama |
| 6,708,145 | B1 | 3/2004 | Liljeryd et al. |
| 7,216,074 | B2 | 5/2007 | Malah et al. |
| 7,328,160 | B2 | 2/2008 | Nishio et al. |
| 7,328,162 | B2 | 2/2008 | Liljeryd et al. |
| 7,359,854 | B2 | 4/2008 | Nilsson et al. |
| 7,433,817 | B2 | 10/2008 | Kjörling et al. |
| 7,447,631 | B2 | 11/2008 | Truman et al. |
| 7,469,206 | B2 | 12/2008 | Kjörling et al. |
| 7,546,237 | B2 | 6/2009 | Nongpiur et al. |
| 7,627,469 | B2 * | 12/2009 | Nettre et al. ..... 704/220 |

(Continued)

FOREIGN PATENT DOCUMENTS

WO WO 2007/087824 A1 8/2007

OTHER PUBLICATIONS

International Search Report and Written Opinion, International application No. PCT/US2009/056117, Date of mailing Oct. 19, 2009, 8 pages.

(Continued)

*Primary Examiner* — Jakieda Jackson
(74) *Attorney, Agent, or Firm* — Slater & Matsil, L.L.P.

(57) ABSTRACT

A transmitted data that includes audio data and a transmitted spectral sharpness parameter representing a spectral harmonic/noise sharpness of a plurality of subbands are received. A measured spectral sharpness parameter is estimated from received audio data. The transmitted spectral sharpness parameter is compared with the measured spectral sharpness parameter. A main sharpness control parameter is formed for each of the decoded subbands. The main sharpness control parameter for each of the decoded subbands is analyzed. Ones of the decoded subbands are sharpened if the corresponding main sharpness control indicates that a corresponding subband is not sharp enough, wherein sharpened subbands are formed. Likewise, ones of the decoded subbands are flattened if the corresponding main sharpness control indicates that a corresponding subband is not flat enough, wherein flattened subbands are formed. An energy level of each sharpened subband and each flattened subband is normalized to keep an energy level of each sharpened and/or flattened subband substantially unchanged.

17 Claims, 4 Drawing Sheets

(56) References Cited

U.S. PATENT DOCUMENTS

| | | | | |
|---|---|---|---|---|
| 2002/0002456 | A1* | 1/2002 | Vainio et al. | 704/258 |
| 2003/0093278 | A1 | 5/2003 | Malah | |
| 2003/0200092 | A1 | 10/2003 | Gao et al. | |
| 2004/0015349 | A1* | 1/2004 | Vinton et al. | 704/230 |
| 2004/0181397 | A1 | 9/2004 | Gao | |
| 2004/0225505 | A1 | 11/2004 | Andersen et al. | |
| 2005/0159941 | A1 | 7/2005 | Kolesnik et al. | |
| 2005/0165603 | A1 | 7/2005 | Bessette et al. | |
| 2005/0278174 | A1 | 12/2005 | Sasaki et al. | |
| 2006/0036432 | A1 | 2/2006 | Kjorling et al. | |
| 2006/0147124 | A1 | 7/2006 | Edler et al. | |
| 2006/0271356 | A1 | 11/2006 | Vos | |
| 2007/0088558 | A1 | 4/2007 | Vos et al. | |
| 2007/0255559 | A1 | 11/2007 | Gao et al. | |
| 2007/0282603 | A1 | 12/2007 | Bessette | |
| 2007/0299662 | A1 | 12/2007 | Kim et al. | |
| 2007/0299669 | A1 | 12/2007 | Ehara | |
| 2008/0010062 | A1 | 1/2008 | Son et al. | |
| 2008/0027711 | A1 | 1/2008 | Rajendran et al. | |
| 2008/0052066 | A1 | 2/2008 | Oshikiri et al. | |
| 2008/0052068 | A1 | 2/2008 | Aguilar et al. | |
| 2008/0091418 | A1 | 4/2008 | Laaksonen et al. | |
| 2008/0120117 | A1 | 5/2008 | Choo et al. | |
| 2008/0126081 | A1 | 5/2008 | Geiser et al. | |
| 2008/0126086 | A1 | 5/2008 | Vos et al. | |
| 2008/0154588 | A1 | 6/2008 | Gao | |
| 2008/0195383 | A1 | 8/2008 | Shlomot et al. | |
| 2008/0208572 | A1 | 8/2008 | Nongpiur et al. | |
| 2009/0024399 | A1 | 1/2009 | Gartner et al. | |
| 2009/0125301 | A1 | 5/2009 | Master et al. | |
| 2009/0254783 | A1 | 10/2009 | Hirschfeld et al. | |
| 2010/0063802 | A1 | 3/2010 | Gao | |
| 2010/0063810 | A1 | 3/2010 | Gao | |
| 2010/0063827 | A1 | 3/2010 | Gao | |
| 2010/0070269 | A1 | 3/2010 | Gao | |
| 2010/0070270 | A1 | 3/2010 | Gao | |
| 2010/0121646 | A1 | 5/2010 | Ragot et al. | |
| 2010/0211384 | A1 | 8/2010 | Qi et al. | |
| 2010/0292993 | A1 | 11/2010 | Vaillancourt et al. | |

OTHER PUBLICATIONS

"G.729-based embedded variable bit-rate coder: An 8-32 kbit/s scalable wideband coder bitstream interoperable with G.729," Series G: Transmission Systems and Media, Digital Systems and Networks, Digital terminal equipments—Coding of analogue signals by methods other than PCM, International Telecommunication Union, ITU-T Recommendation G.729.1, May 2006, 100 pages.

International Search Report and Written Opinion, International Application No. PCT/US2009/056106, Huawei Technologies Co., Ltd., Date of Mailing Oct. 19, 2009, 11 pages.

International Search Report and Written Opinion, International Application No. PCT/US2009/056111, GH Innovation, Inc. Date of Mailing Oct. 23, 2009, 13 pages.

International Search Report and Written Opinion, International Application No. PCT/US2009/056113, Huawei Technologies Co., Ltd., Date of Mailing Oct. 22, 2009, 10 pages.

International Search Report and Written Opinion, International Application No. PCT/US2009/056860, SRS Labs, Inc., Date of Mailing Oct. 26, 2009, 11 pages.

International Search Report and Written Opinion, International Application No. PCT/US2009/56981, GH Innovation, Inc., Date of Mailing Nov. 2, 2009, 11 pages.

* cited by examiner

SPECTRUM HARMONIC/NOISE SHARPNESS CONTROL

This patent application claims priority to U.S. Provisional Application No. 61/094,883, filed on Sep. 6, 2008, and entitled "Spectrum Harmonic/Noise Sharpness Control," which application is incorporated herein by reference.

TECHNICAL FIELD

The present invention relates generally to audio transform coding, and, in particular embodiments, to a system and method for spectrum harmonic/noise sharpness control.

BACKGROUND

In modern audio/speech signal compression technology, a concept of BandWidth Extension (BWE) is widely used. The similar or same technology sometimes is also called High Band Extension (HBE), SubBand Replica (SBR), or Spectral Band Replication (SBR). Although the name could be different, they all have the similar meaning of encoding/decoding some frequency sub-bands (usually high bands) with little budget of bit rate (or even with zero budget of bit rate) or significantly lower bit rate than normal encoding/decoding approaches. Low bit rate coding sometimes causes low quality. If a few bits can improve the quality, it is worth spending the few bits.

Frequency domain can be defined as FFT transformed domain. It can also be in Modified Discrete Cosine Transform (MDCT) domain. A well known BWE can be found in the standard ITU-T G.729.1, in which the algorithm is named as Time Domain Bandwidth Extension (TDBWE).

General Description of ITU G.729.1

ITU-T G.729.1 is also called a G.729EV coder, which is an 8-32 kbit/s scalable wideband (50 Hz-7,000 Hz) extension of ITU-T Rec. G.729. By default, the encoder input and decoder output are sampled at 16,000 Hz. The bitstream produced by the encoder is scalable and consists of 12 embedded layers, which will be referred to as Layers 1 to 12. Layer 1 is the core layer corresponding to a bit rate of 8 kbit/s. This layer is compliant with G.729 bitstream, which makes G.729EV interoperable with G.729. Layer 2 is a narrowband enhancement layer adding 4 kbit/s, while Layers 3 to 12 are wideband enhancement layers adding 20 kbit/s with steps of 2 kbit/s.

The G.729EV coder is designed to operate with a digital signal sampled at 16,000 Hz followed by a conversion to 16-bit linear PCM before the converted signal is inputted to the encoder. However, the 8,000 Hz input sampling frequency is also supported. Similarly, the format of the decoder output is 16-bit linear PCM with a sampling frequency of 8,000 or 16,000 Hz. Other input/output characteristics are converted to 16-bit linear PCM with 8,000 or 16,000 Hz sampling before encoding, or from 16-bit linear PCM to the appropriate format after decoding. The bitstream from the encoder to the decoder is defined within this Recommendation.

The G.729EV coder is built upon a three-stage structure: embedded Code-Excited Linear-Prediction (CELP) coding, Time-Domain Bandwidth Extension (TDBWE), and predictive transform coding that is also referred to as Time-Domain Aliasing Cancellation (TDAC). The embedded CELP stage generates Layers 1 and 2, which yield a narrowband synthesis (50 Hz-4,000 Hz) at 8 kbit/s and 12 kbit/s. The TDBWE stage generates Layer 3 and allows producing a wideband output (50 Hz-7,000 Hz) at 14 kbit/s. The TDAC stage operates in the MDCT domain and generates Layers 4 to 12 to improve quality from 14 kbit/s to 32 kbit/s. TDAC coding represents the weighted CELP coding error signal in the 50 Hz-4,000 Hz band and the input signal in the 4,000 Hz-7,000 Hz band.

The G.729EV coder operates on 20 ms frames. However, the embedded CELP coding stage operates on 10 ms frames, such as G.729 frames. As a result, two 10 ms CELP frames are processed per 20 ms frame. In the following, to be consistent with the context of ITU-T Rec. G.729, the 20 ms frames used by G.729EV will be referred to as superframes, whereas the 10 ms frames and the 5 ms subframes involved in the CELP processing will be called frames and subframes, respectively.

TDBWE Encoder

The TDBWE encoder is illustrated in FIG. 1. The TDBWE encoder extracts a fairly coarse parametric description from the pre-processed and down-sampled higher-band signal 101, $s_{HB}(n)$. This parametric description comprises time envelope 102 and frequency envelope 103 parameters. The 20 ms input speech superframe $s_{HB}(n)$ (8 kHz sampling frequency) is subdivided into 16 segments of length 1.25 ms each, i.e., with each segment comprising 10 samples. The 16 time envelope parameters 102, Tenv(i), i=0, . . . , 15, are computed as logarithmic subframe energies before the quantization is performed. For the computation of the 12 frequency envelope parameters 103, Fenv(j), j=0, . . . , 11, the signal 101, $s_{HB}(n)$, is windowed by a slightly asymmetric analysis window. This window is 128 tap long (16 ms) and is constructed from the rising slope of a 144-tap Hanning window, followed by the falling slope of a 112-tap Hanning window.

The maximum of the window is centered on the second 10 ms frame of the current superframe. The window is constructed such that the frequency envelope computation has a lookahead of 16 samples (2 ms) and a lookback of 32 samples (4 ms). The windowed signal is transformed by FFT. The even number of bins of the full length 128-tap FFT are computed using a polyphase structure. Finally, the frequency envelope parameter set is calculated as logarithmic weighted sub-band energies for 12 evenly spaced and equally wide overlapping sub-bands in the FFT domain.

TDBWE Decoder

FIG. 2 illustrates the concept of the TDBWE decoder module. The TDBWE received parameters, which are computed by parameter extraction procedure, and are used to shape an artificially generated excitation signal 202, $\hat{s}_{HB}^{exc}(n)$, according to desired time and frequency envelopes $\hat{T}_{env}(i)$ and $\hat{F}_{env}(j)$. This is followed by a time-domain post-processing procedure.

The TDBWE excitation signal 201, exc(n), is generated by 5 ms subframe based on parameters which are transmitted in Layers 1 and 2 of the bitstream. Specifically, the following parameters are used: the integer pitch lag $T_0$=int($T_1$) or int ($T_2$) depending on the subframe, the fractional pitch lag frac, the energy $E_c$ of the fixed codebook contributions, and the energy $E_p$ of the adaptive codebook contribution. Energy $E_c$ is mathematically expressed as $$E_p = \sum_{n=0}^{39} (\hat{g}_p \cdot v(n))^2.$$

while energy $E_p$ is expressed as $$E_c = \sum_{n=0}^{39} (\hat{g}_c \cdot c(n) + \hat{g}_{enh} \cdot c'(n))^2,$$

A detailed description can be found in the ITU G.729.1 Recommendation.

The parameters of the excitation generation are computed every 5 ms subframe. The excitation signal generation consists of the following steps:

- estimation of two gains $g_v$ and $g_{uv}$ for the voiced and unvoiced contributions to the final excitation signal exc (n);
- pitch lag post-processing;
- generation of the voiced contribution;
- generation of the unvoiced contribution; and
- low-pass filtering.

In G.729.1, TDBWE is used to code the wideband signal from 4 kHz to 7 kHz. The narrow band (NB) signal from 0 to 4 kHz is coded with G729 CELP coder, wherein the excitation consists of adaptive codebook contribution and fixed codebook contribution. The adaptive codebook contribution comes from the voiced speech periodicity. The fixed codebook contributes to unpredictable portion. The ratio ξ of the energies of the adaptive and fixed codebook excitations (including enhancement codebook) is computed for each subframe as:

$$\xi = \frac{E_p}{E_c}. \tag{1}$$

In order to reduce this ratio ξ in case of unvoiced sounds, a "Wiener filter" characteristic is applied:

$$\xi_{post} = \xi \cdot \frac{\xi}{1+\xi}. \tag{2}$$

This leads to more consistent unvoiced sounds. The gains for the voiced and unvoiced contributions of exc(n) are determined using the following procedure. An intermediate voiced gain $g'_v$ is calculated by:

$$g'_v = \sqrt{\frac{\xi_{post}}{1+\xi_{post}}}, \tag{3}$$

which is slightly smoothed to obtain the final voiced gain $g_v$:

$$g_v = \sqrt{\frac{1}{2}(g'^2_v + g'^2_{v,old})}, \tag{4}$$

where $g'_{v,old}$ is the value of $g'_v$ of the preceding subframe.

To satisfy the constraint $g_v^2+g_{uv}^2=1$, the unvoiced gain is represented as:

$$g_{uv}=\sqrt{1-g_v^2}. \tag{5}$$

The generation of a consistent pitch structure within the excitation signal exc(n) requires a good estimate of the fundamental pitch lag $t_0$ of the speech production process. Within Layer 1 of the bitstream, the integer and fractional pitch lag values $T_0$ and frac are available for the four 5 ms subframes of the current superframe. For each subframe, the estimation of $t_0$ is based on these parameters.

The aim of the G.729 encoder-side pitch search procedure is to find the pitch lag, which minimizes the power of the LTP residual signal. That is, the LTP pitch lag is not necessarily identical with $t_0$, which is a requirement for the concise reproduction of voiced speech components. The most typical deviations are pitch-doubling and pitch-halving errors, i.e., the frequency corresponding to the LTP lag is a half or double that of the original fundamental speech frequency. Especially, pitch-doubling (or tripling, etc.) errors are preferably avoided. Thus, the following post-processing of the LTP lag information is used. First, the LTP pitch lag for an oversampled time-scale is reconstructed from $T_0$ and frac, and a bandwidth expansion factor of 2 is considered:

$$t_{LTP}=2\cdot(3\cdot T_0+\text{frac}). \tag{6}$$

The (integer) factor between the currently observed LTP lag $t_{LTP}$ and the post-processed pitch lag of the preceding subframe $t_{post,old}$ (see Equation 9) is calculated as:

$$f = \text{int}\left(\frac{t_{LTP}}{t_{post,old}} + 0.5\right). \tag{7}$$

If the factor f falls into the range 2, . . . , 4, a relative error is evaluated as:

$$e = 1 - \frac{t_{LTP}}{f \cdot t_{post,old}}. \tag{8}$$

If the magnitude of this relative error is below a threshold $\epsilon=0.1$, it is assumed that the current LTP lag is the result of a beginning pitch-doubling (-tripling, etc.) error phase. Thus, the pitch lag is corrected by dividing by the integer factor f, thereby producing a continuous pitch lag behavior with respect to the previous pitch lags:

$$t_{post} = \begin{cases} \text{int}\left(\frac{t_{LTP}}{f} + 0.5\right) & |e| < \varepsilon,\ f > 1,\ f < 5 \\ t_{LTP} & \text{otherwise,} \end{cases} \tag{9}$$

which is further smoothed as:

$$t_p = \frac{1}{2}\cdot(t_{post,old} + t_{post}). \tag{10}$$

Note that this moving average leads to a virtual precision enhancement from a resolution of ⅓ to ⅙ of a sample. Finally, the post-processed pitch lag $t_p$ is decomposed into integer and fractional parts:

$$t_{0,int} = \text{int}\left(\frac{t_p}{6}\right) \tag{11}$$

and $$t_{0,frac} = t_p - 6\cdot t_{0,int}.$$

The voiced components 206, $s_{exc,v}(n)$, of the TDBWE excitation signal are represented as shaped and weighted glottal pulses. The voiced components 206 $s_{exc,v}(n)$ are thus produced by overlap-add of single pulse contributions:

$$S_{exc,v}(n) = \sum_{p} g_{Pulse}^{[p]} \times P_{n_{Pulse,frac}^{[p]}}\left(n - n_{Pulse,int}^{[p]}\right), \quad (12)$$

where $n_{Pulse,int}^{[p]}$ is a pulse position, $P_{n_{Pulse,frac}^{[p]}}(n-n_{pulse,int}^{[p]})$ is the pulse shape, and $g_{Pulse}^{[p]}$ a gain factor for each pulse. These parameters are derived in the following. The post-processed pitch lag parameters $t_{0,int}$ and $t_{0,frac}$ determine the pulse spacing. Accordingly, the pulse positions may be expressed as:

$$n_{Pulse,int}^{[p]} = n_{Pulse,int}^{[p-1]} + t_{0,int} + \text{int}\left(\frac{n_{Pulse,frac}^{[p-1]} + t_{0,frac}}{6}\right), \quad (13)$$

where p is the pulse counter, i.e., $n_{Pulse,int}^{[p]}$ is the (integer) position of the current pulse and $n_{Pulse,int}^{[p-1]}$ is the (integer) position of the previous pulse.

The fractional part of the pulse position may be expressed as:

$$n_{Pulse,frac}^{[p]} = n_{Pulse,frac}^{[p-1]} + t_{0,frac} - 6 \cdot \text{int}\left(\frac{n_{Pulse,frac}^{[p-1]} + t_{0,frac}}{6}\right) \quad (14)$$

The fractional part of the pulse position serves as an index for the pulse shape selection. The prototype pulse shapes $P_i(n)$ with i=0, . . . , 5 and n=0, . . . , 56 are taken from a lookup table as plotted in FIG. 3. These pulse shapes are designed such that a certain spectral shaping, for example, a smooth increase of the attenuation of the voiced excitation components towards higher frequencies, is incorporated and the full sub-sample resolution of the pitch lag information is utilized. Further, the crest factor of the excitation signal is significantly reduced and an improved subjective quality is obtained.

The gain factor $g_{Pulse}^{[p]}$ for the individual pulses is derived from the voiced gain parameter $g_v$ and from the pitch lag parameters:

$$g_{Pulse}^{[p]} = (2 \cdot \text{even}(n_{Pulse,int}^{[p]}) - 1) \cdot g_v \cdot \sqrt{6t_{0,int} + t_{0,frac}}. \quad (15)$$

Therefore, it is ensured that increasing pulse spacing does not result in the decrease in the contained energy. The function even( ) returns 1 if the argument is an even integer number, and returns 0 otherwise.

The unvoiced contribution 207, $s_{exc,uv}(n)$, is produced using the scaled output of a white noise generator:

$$s_{exc,uv}(n) = g_{uv} \cdot \text{random}(n), \; n=0, \ldots, 39. \quad (16)$$

Having the voiced and unvoiced contributions $s_{exc,v}(n)$ and $s_{exc,uv}(n)$, the final excitation signal 202, $s_{HB}^{exc}(n)$, is obtained by low-pass filtering of $exc(n)=S_{exc,v}(n)+S_{exc,uv}(n)$.

The low-pass filter has a cut-off frequency of 3,000 Hz and its implementation is identical with the pre-processing low-pass filter for the high band signal.

The shaping of the time envelope of the excitation signal $s_{HB}^{exc}(n)$ utilizes the decoded time envelope parameters $\hat{T}_{env}(i)$ with i=0, . . . , 15 to obtain a signal 203, $\hat{s}_{HB}^{T}(n)$, with a time envelope which is nearly identical to the time envelope of the encoder side HB signal $s_{HB}(n)$. This is achieved by a simple scalar multiplication of a gain function $g_T(n)$ with the excitation signal $s_{HB}^{exc}(n)$. In order to determine the gain function $g_T(n)$, the excitation signal $s_{HB}^{exc}(n)$ is segmented and analyzed in the same manner as described for the parameter extraction in the encoder. The obtained analysis results from $s_{HB}^{exc}(n)$ are, again, time envelope parameters $\tilde{T}_{env}(i)$ with i=0, . . . , 15. They describe the observed time envelope $s_{HB}^{exc}(n)$. Then, a preliminary gain factor is calculated by comparing $\hat{T}_{env}(i)$ with $\tilde{T}_{env}(i)$. For each signal segment with index i=0, . . . , 15, these gain factors are interpolated using a "flat-top" Hanning window. This interpolation procedure finally yields the desired gain function.

The decoded frequency envelope parameters $\hat{F}_{env}(j)$ with j=0, . . . , 11 are representative for the second 10 ms frame within the 20 ms superframe. The first 10 ms frame is covered by parameter interpolation between the current parameter set and the parameter set from the preceding superframe. The superframe of 203, $\hat{s}_{HB}^{T}(n)$, is analyzed twice per superframe. This is done for the first (l=1) and for the second (l=2) 10 ms frame within the current superframe and yields two observed frequency envelope parameter sets $\tilde{F}_{env,l}(j)$ with j=0, . . . , 11 and frame index l=1, 2. Now, a correction gain factor per sub-band is determined for the first frame and for the second frame by comparing the decoded frequency envelope parameters $\hat{F}_{env}(j)$ with the observed frequency envelope parameter sets $\tilde{F}_{env,l}(j)$. These gains control the channels of a filterbank equalizer. The filterbank equalizer is designed such that its individual channels match the sub-band division. It is defined by its filter impulse responses and a complementary high-pass contribution.

The signal 204, $\hat{s}_{HB}^{F}(n)$, is obtained by shaping both the desired time and frequency envelopes on the excitation signal $s_{HB}^{exc}(n)$ (generated from parameters estimated in lower-band by the CELP decoder). There is in general no coupling between this excitation and the related envelope shapes $\hat{T}_{env}(i)$ and $\hat{F}_{env}(j)$. As a result, some clicks may occur in the signal $\hat{s}_{HB}^{F}(n)$. To attenuate these artifacts, an adaptive amplitude compression is applied to $\hat{s}_{HB}^{F}(n)$. Each sample of $\hat{s}_{HB}^{F}(n)$ of the i-th 1.25 ms segment is compared to the decoded time envelope $\hat{T}_{env}(i)$, and the amplitude of $\hat{s}_{HB}^{F}(n)$ is compressed in order to attenuate large deviations from this envelope. The signal after this post-processing is named as 205, $\hat{s}_{HB}^{bwe}(n)$.

SUMMARY OF THE INVENTION

Embodiments of the present invention are generally in the field of speech/audio transform coding. In particular, embodiments of the present invention relate to the field of low bit rate speech/audio transform coding, and are specifically related to applications in which ITU-T G.729.1 and/or G.718 super-wideband extension are involved One embodiment of the invention discloses a method of controlling spectral harmonic/noise sharpness of decoded subbands. The spectral sharpness parameter representing the spectral harmonic/noise sharpness of the each subband at encoder side is estimated. The spectral sharpness parameter (s) are quantized and the quantized sharpness parameter(s) are transmitted from the encoder to a decoder. The spectral sharpness parameter of each decoded subband at decoder side is estimated. The corresponding transmitted sharpness parameter(s) from encoder are compared with the corresponding measured spectral sharpness parameter(s) at decoder and the main sharpness control parameter for the each decoded subband is formed. The main sharpness control parameter for the each decoded subband is analyzed and the decoded spectral subband is made sharper if judged not sharp enough. In addition, or alternatively, the decoded spectral subband is made flatter or noisier if judged not flat or noisy enough. The energy level of the each modified subband is normalized to keep the energy level almost unchanged.

In one example, the spectral sharpness parameter representing the spectral harmonic/noise sharpness of the each subband is estimated by calculating the magnitude ratio between the average magnitude and maximum magnitude or the energy level ratio between the average energy level and maximum energy level. If a plurality of the spectral sharpness parameters are estimated on a plurality of the subbands, the one spectral sharpness parameter estimated from the sharpest spectral subband can be chosen to represent the spectral sharpness of the plurality of the subbands when the number of bits to transmit the spectral sharpness information is limited.

In another example, each main sharpness control parameter for each decoded subband is formed by analyzing the differences between the corresponding transmitted spectral sharpness parameter(s) and the corresponding measured spectral sharpness parameter(s) from the decoded subbands. Each main sharpness control parameter for the each decoded subband can be smoothed between the current subbands and/or between consecutive frames.

In another example, making the decoded spectral subband sharper is realized by reducing the energy of the frequency coefficients between the harmonic peaks, increasing the energy of the harmonic peaks, and/or reducing the noise component.

In another example, making the decoded spectral subband flatter or noisier is realized by increasing the energy of the frequency coefficients between the harmonic peaks, reducing the energy of the harmonic peaks, and/or increasing the noise component.

In another embodiment, a method of controlling the spectral harmonic/noise sharpness of decoded subbands is disclosed. The spectral sharpness parameter of the each decoded subband at decoder side is estimated. The main sharpness control parameter for each decoded subband is formed. The main sharpness control parameter for the each decoded subband is analyzed and the decoded spectral subband is made sharper if judged not sharp enough. The energy level of the each modified subband is normalized to keep the energy level almost unchanged.

In one example, each main sharpness control parameter for each decoded subband is formed by smoothing the spectral sharpness parameters of the decoded subbands between the current subbands and/or between consecutive frames.

In another example, the decoded subband showing sharper spectrum is made further sharper than the other decoded subbands showing less sharp in terms of comparing the main sharpness control parameters of the decoded subbands.

A method of influencing the bit allocation to different subbands is disclosed in another embodiment. The spectral sharpness parameter of each subband is estimated. The values of the spectral sharpness parameters from the different subbands are compared. The allocation of more bits or extra bits is favored for coding the subband that shows sharper spectrum than the other subband that shows less sharp or flatter spectrum according to the comparison of estimated spectral sharpness parameters.

In one example, when the sharper subbands get more bits, the flatter subbands get fewer bits if the total bit budget is fixed. The importance order of the subbands is determined according to both the spectral sharpness distribution and the energy level distribution of the subbands.

BRIEF DESCRIPTION OF THE DRAWINGS

For a more complete understanding of the present invention, and the advantages thereof, reference is now made to the following descriptions taken in conjunction with the accompanying drawing, in which.

DETAILED DESCRIPTION OF ILLUSTRATIVE EMBODIMENTS

Figure 1:
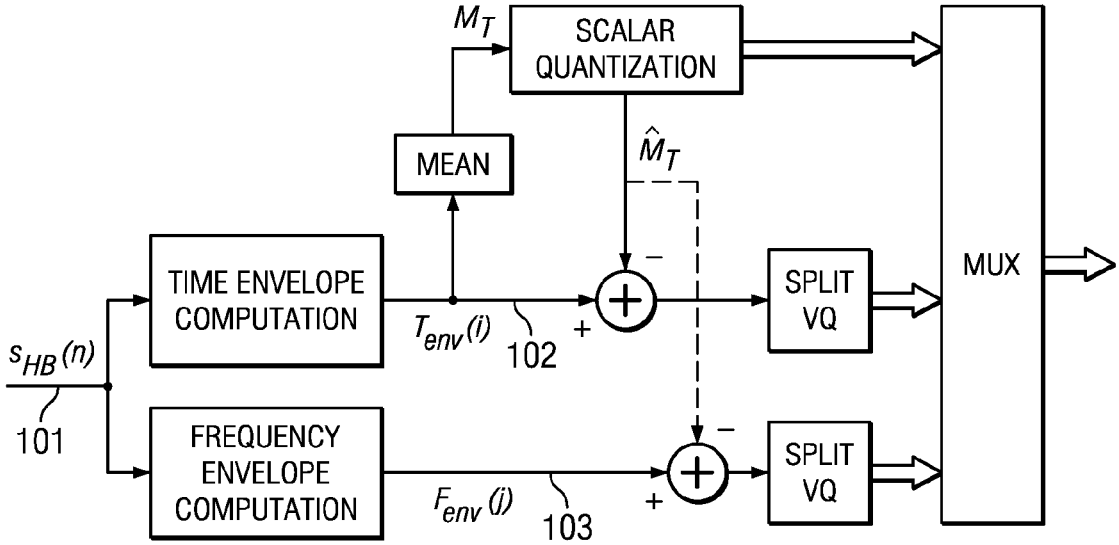
FIG. 1 (PRIOR ART)
FIG. 1 illustrates a high-level block diagram of the TDBWE encoder for G.729.1.

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Low bit rate coding sometimes causes low quality. One typical low bit rate transform coding method is the BWE algorithm; another example of low bit rate transform coding is that spectrum subbands of high band are generated through limited intra-frame frequency prediction from low band to high band. Because of the low bit rate, fine spectral structure is often not precise enough. With a generated fine spectral structure or a coded spectrum with a low bit rate, there exists often the problem of incorrect spectral harmonic/noise sharpness, which means it could be over-harmonic (over-sharp) or over-noisy (over-flat). Embodiments of the present invention utilize efficient methods to control spectral harmonic/noise sharpness. Harmonic/noise sharpness measuring is introduced, which is not simply based on signal periodicity. Measuring spectral sharpness can be also used to influence bit allocation for different subbands.

BandWidth Extension (BWE) has been widely used. The similar or same technology is sometimes referred to as High Band Extension (HBE), SubBand Replica (SBR), or Spectral Band Replication (SBR). They all have the similar or same meaning of encoding/decoding some frequency sub-bands (usually high bands) with little budget of bit rate (or even with zero budget of bit rate) or significantly lower bit rate than normal encoding/decoding approaches.

BWE is often used to encode and decode some perceptually critical information within a bit budget while generating some information with very limited bit budget or without spending any number of bits. It usually comprises frequency envelope coding, temporal envelope coding (optional), and spectral fine structure generation. Spectral fine structure is often generated without spending bit budget or by using small number of bits. The corresponding signal in time domain of spectral fine structure is usually called excitation after removing the spectral envelope. The precise description of spectral fine structure needs a lot of bits, which becomes not realistic for any BWE algorithm. A realistic way is to artificially generate spectral fine structure, which means that spectral fine structure is copied from other bands, and mathematically generated according to limited available parameters, or predicted from other bands with very small number of bits.

Due to the fact of low bit rate, not only is spectral fine structure generated by BWE is not precise enough, the coded spectrum with the low bit rate can also be not precise enough perceptually, for example, the coded spectrum with the limited intra-frame frequency prediction approach. With a generated spectral fine structure or coded spectrum with a low bit rate, there often exists the problem of incorrect spectral harmonic/noise sharpness, which means it could be over-harmonic (over-sharp) or over-noisy (over-flat).

Embodiments of this invention propose an efficient method to control spectral harmonic/noise sharpness. Harmonic/noise sharpness measuring is introduced, which is not simply based on signal periodicity. The spectral sharpness measuring can be also used to influence bit allocation for different subbands. In particular, the embodiments can be advantageously used when ITU-T G.729.1/G.718 codecs are in the core layers for a scalable super-wideband codec.

In a conventional G.729.1 TDBWE, the harmonic/noise sharpness is basically controlled by gains $g_v$ and $g_{uv}$, which are expressed in equations (4) and (5). The root control of the gains comes from the energy $E_p$ of the adaptive codebook contribution (also called pitch predictive contribution or Long-Term Prediction contribution) as seen in equation (1). Energy $E_p$ is calculated from the CELP parameters, which are used to encode a low band (Narrow Band), where $g_v$ strongly depends on the periodicity of the signal in low band within the defined pitch range. When $g_v$ is relatively high, the spectrum of the generated excitation will show stronger harmonics (sharper spectrum peaks). Otherwise, a noisier spectrum, and/or a less harmonic or flatter spectrum will be observed. This harmonic/noise sharpness control has two potential problems:

Music signals containing strong harmonics are not necessarily periodic so that the adaptive codebook contribution could be small and the generated excitation with TDBWE would be not harmonic enough (not sharp enough).

When a low band contains strong harmonics, it does not necessarily mean the corresponding high band is also harmonic.

Figure 4:
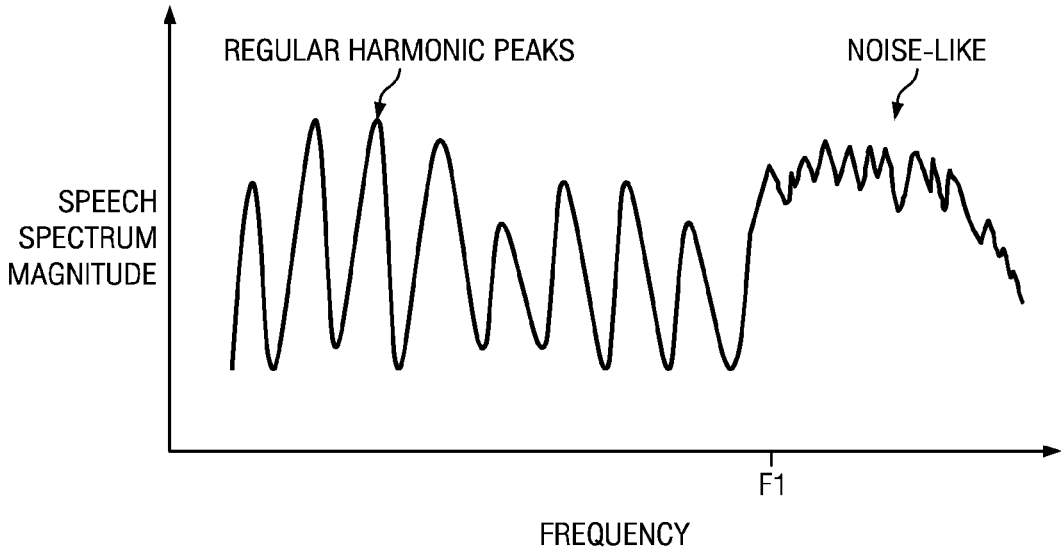
FIG. 4 illustrates an exemplary speech spectrum.
Figure 2:
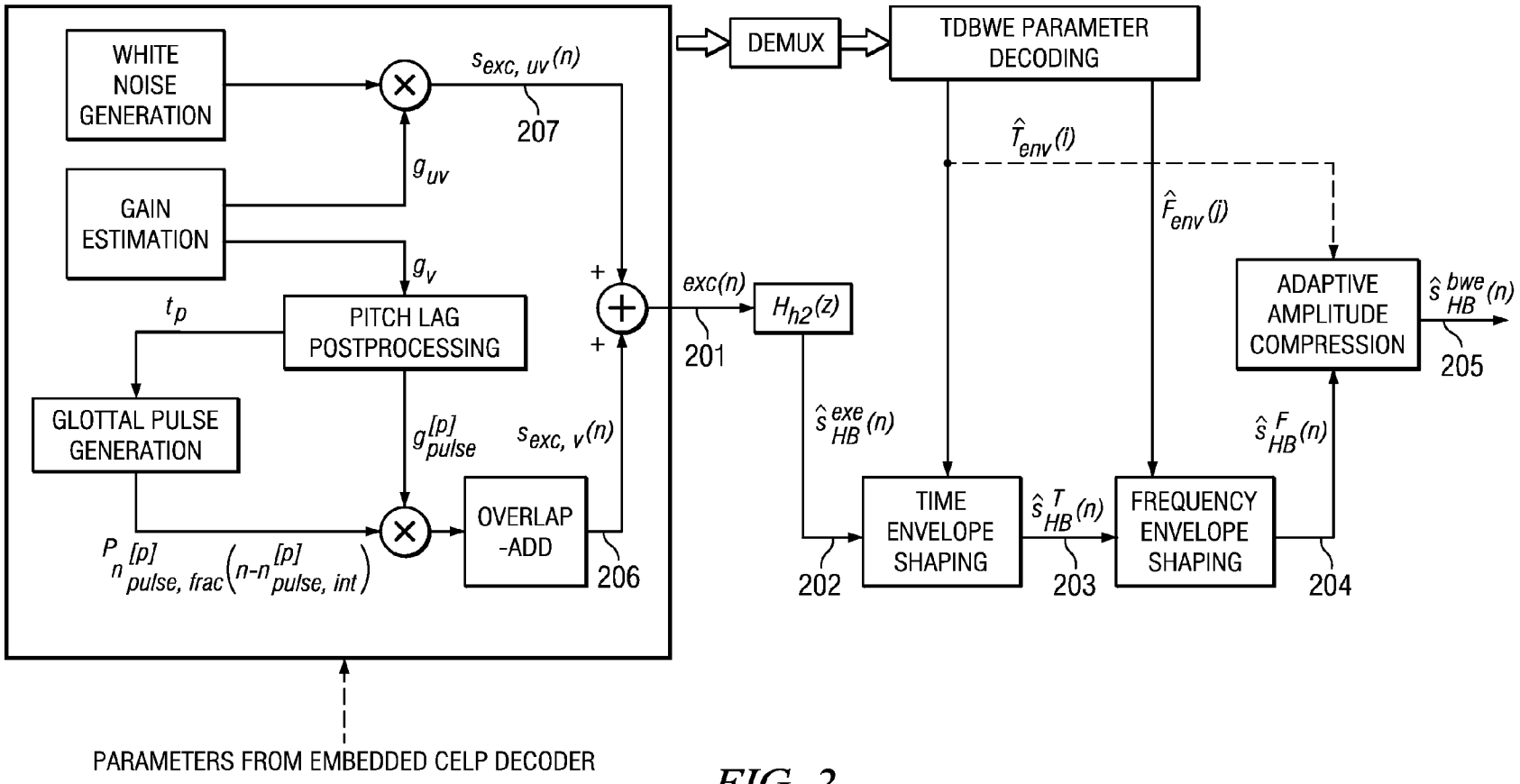
FIG. 2 (PRIOR ART)
FIG. 2 illustrates a high-level block diagram of the TDBWE decoder for G.729.1.
Figure 3:
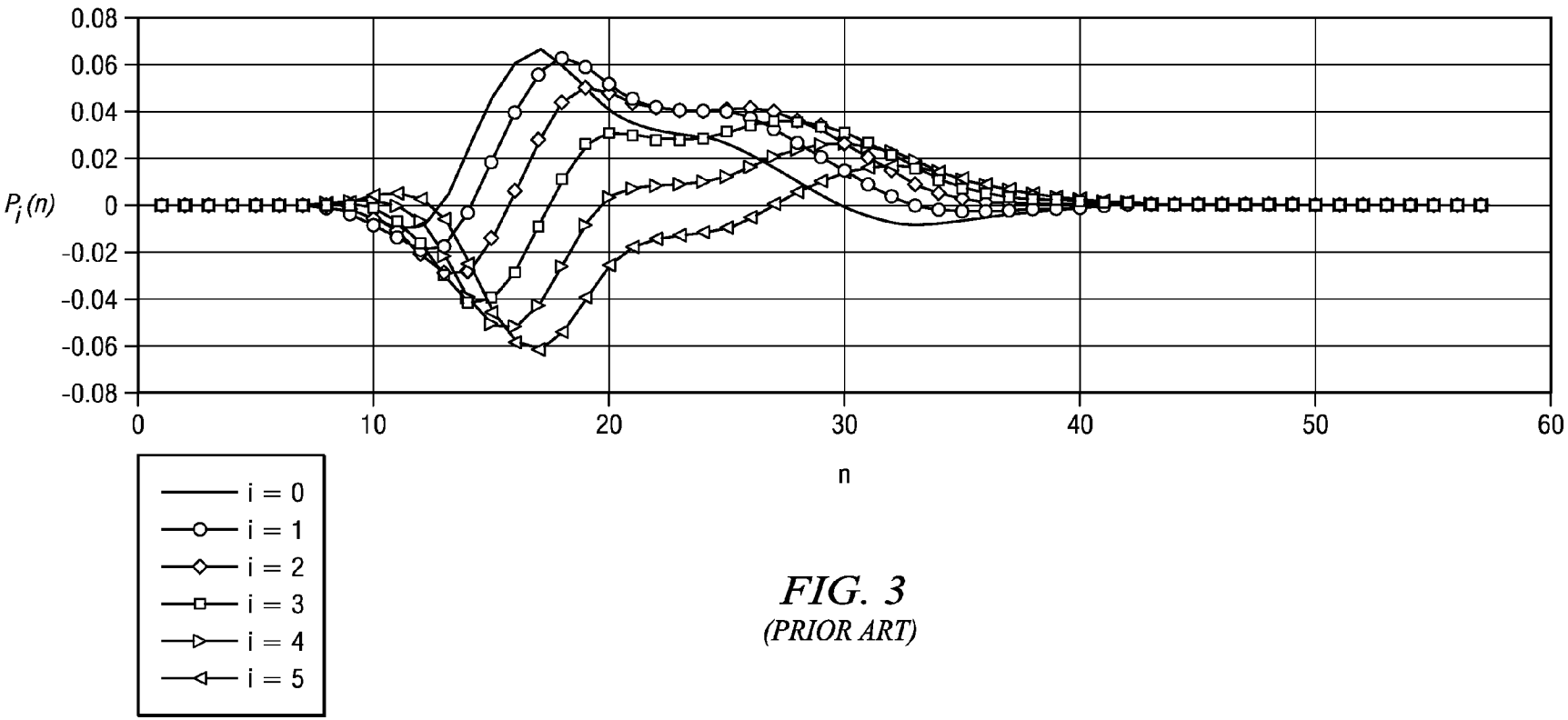
FIG. 3 (PRIOR ART)
FIG. 3 illustrates a pulse shape lookup table for the TDBWE.
Figure 5:
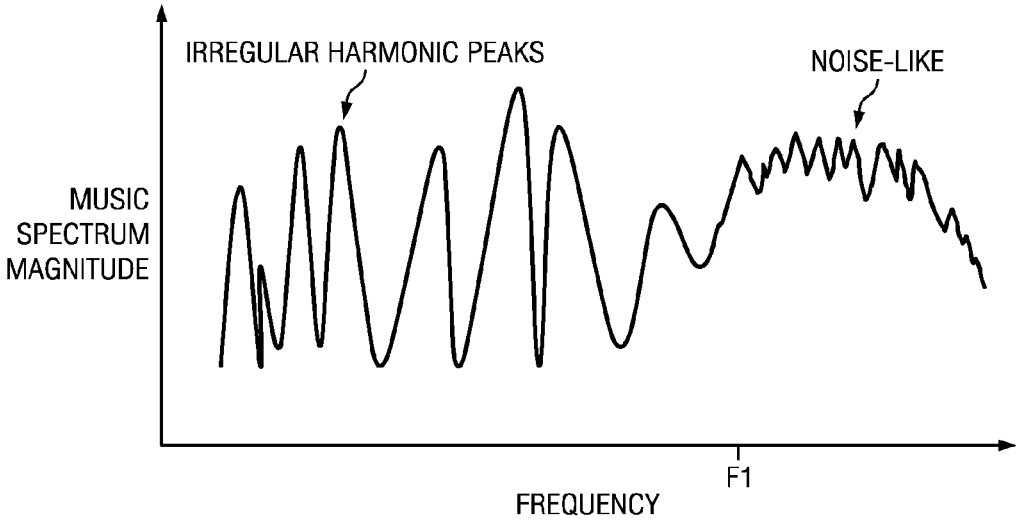
FIG. 5 illustrates an exemplary music spectrum.

The spectrum examples shown in FIG. 4 and FIG. 5 are very commonly seen. For voiced speech, it is likely that the low frequency area contains more regular harmonics and the high frequency area is noise-like. The human ear is more sensitive to a coding error in a harmonic area than in noise-like area. A human voiced signal generally has regular harmonics as shown in FIG. 4 so that the voicing gain $g_v$ in equation (4) can reflect the sharpness of the harmonics in low band. However, for a music signal as shown in FIG. 5, the harmonics are not regularly spaced so that the signal having harmonics is not necessarily periodic. A non-periodic signal would result in low voicing gain, although a high voicing gain is needed for a TDBWE to have enough strong harmonics. From both FIG. 4 and FIG. 5, we can see that harmonic low band may not always be able to predict harmonic high band. In any BWE algorithm or low bit rate coding algorithm, a wrong parameter estimation could cause an incorrect spectral sharpness. Actually, for any low bit rate coding, even if every spectral subband is coded, the spectral sharpness may still not be satisfactory.

Exemplary embodiments can the harmonic/noise sharpness control for spectral subbands decoded at low bit rates. An exemplary embodiment includes the following points:

Dividing the related spectrum into several subbands.

The spectral harmonic sharpness in each subband is described by using a sharpness measuring parameter instead of a periodicity measuring parameter. A typical sharpness measuring parameter can be defined as the following, $$Shp(i) = \frac{\frac{1}{N_i}\sum_k |MDCT_i(k)|}{\mathrm{Max}\{|MDCT_i(k)|,\ k = 0, 1, \ldots, N_i\}}, \tag{17}$$

where $MDCT_i(k)$ are frequency domain coefficients in i-th subband, and $N_i$ is the number of coefficients in i-th subband. The numerator of equation (17) represents the average spectrum magnitude in the subband indexed as i. The denominator in equation (17) is defined as the maximum spectrum magnitude in the same subband. The ratio calculated by equation (17) indicates the harmonic/noise sharpness of the specific subband. If the parameter defined in equation (17) is smaller, it means the corresponding subband is sharper. Otherwise, if this parameter is greater, the corresponding subband is flatter, noisier, or less sharp. This sharpness parameter estimated at the encoder side can be quantized by 1 bit or a few bits. The quantization index is then sent to the decoder.

At the decoder side, the generated excitation or the corresponding spectral fine structure consists of a harmonic component and a noise component. These subbands can be copied from other available subbands, constructed according to some available parameters, predicted from other available subbands, or coded with low bit rates. One difference of this embodiment from the prior art is that the relationship (or energy ratio) between the harmonic component and noise component is based on the sharpness measuring parameter instead of based on the low band periodicity measuring parameter. In the embodiment, first, the spectral sharpness of each generated or decoded subband is measured by using the similar sharpness measuring approach as in encoder. Then, the sharpness parameter (reference sharpness) estimated and transmitted from encoder is compared with the one obtained from generated or decoded subbands. If the comparison indicates that the generated or decoded subbands are sharper (more harmonic) than the reference, the noise component needs to be increased relative to the harmonic component. Otherwise, if the comparison indicates that the generated or decoded subbands are flatter (noisier) than the reference, the noise component needs to be decreased relative to the harmonic component and the spectral harmonic peaks should be enhanced or made sharper. The transmitted sharpness parameter can be smoothened at the decoder side between different subbands and/or between consecutive frames.

At the decoder side, adding or reducing the noise component can change the spectral sharpness. This method may be combined with other methods to change the spectral sharpness, such as enhancing the spectrum peaks while reducing the energy between harmonic peaks to make the spectral harmonic peaks sharper or reducing the harmonic peaks while increasing the energy between harmonic peaks to make the spectrum flatter.

An exemplary embodiment based on the above described-points is provided as follows. At encoder side, the high band [7 kHz,14 kHz] of the original signal is divided into 4 subbands in the MDCT domain, where each subband contains 70 coefficients. In each subband of 70 coefficients, one spectral sharpness parameter in the first half subband (with 35 coefficients) and another spectral sharpness parameter in the second half subband (with 35 coefficients) are estimated respectively according to equation (17). The smaller one named as shp_enc of these two sharpness values is chosen to represent the spectral sharpness of the corresponding subband of 70 coefficients. One bit is used to tell decoder if this sharpness value is smaller than 0.18 (shp_enc<0.18) or not.

At the decoder side, there are also 8 half subbands, each having 35 coefficients, resulting in the total number of 8×35=280 coefficients, which represent the high band [7 kHz, 14 kHz]. The spectral sharpness parameters of the generated subbands or decoded subbands are estimated in each half subband of 35 coefficients in the same way as encoder with equation (17). Let's note shp_dec as the estimated sharpness value for each half subband of 35 coefficients at decoder side. A primary sharpness control value noted as Sharp_c is first evaluated in terms of the difference between shp_enc and shp_dec in the following way:

```
/*  Comparing shp_dec to shp_enc */
    Sharp_c = 0;
    if (shp_enc >= 0.18) {
            if (Sharp_dec< 0.12) {
                    Sharp_c = −0.75;
            }
            else if (Sharp_dec< 0.16) {
                    Sharp_c = −0.5;
            }
            else if (Sharp_dec< 0.2) {
                    Sharp_c = −0.25;
            }
    }
    else { /*shp_enc < 0.18*/
            if (Sharp_dec> 0.2) {
                    Sharp_c = 0.75;
            }
             else if (Sharp_dec> 0.16) {
                    Sharp_c = 0.5;
            }
            else {
                    Sharp_c = 0.25;
            }
    }
```

Then, the values of Sharp_c from the first half subband to the last half subband is smoothened to obtain the smoothed value, Sharp_c_sm for each half subband. The value of Sharp_c_sm is further smoothened between the consecutive frames to obtain the main sharpness control parameter Sharp_main, which will play the dominant influence for the spectral sharpness control. When Sharp_main is large enough, the corresponding half subband spectrum will be made sharper, and the greater Sharp_main is, the sharper the spectrum should be. On the other hand, when Sharp_main is small enough, the corresponding half subband spectrum will be made flatter or noisier, and the smaller Sharp_main is, the flatter or noisier the spectrum should be. Finally, the energy after the spectral modification may be normalized to the original energy, which is the same one as before the spectral modification.

From the above description, a method of controlling spectral harmonic/noise sharpness of decoded subbands is provided. The method comprises the steps of: estimating spectral sharpness parameter representing spectral harmonic/noise sharpness of each subband at encoder side; quantizing spectral sharpness parameter(s) and transmitting quantized parameter(s) from encoder to decoder; estimating spectral sharpness parameter of each decoded subband at decoder side; comparing the corresponding transmitted sharpness parameter(s) from encoder with the corresponding spectral sharpness parameter(s) measured at decoder and forming main sharpness control parameter for each decoded subband; analyzing main sharpness control parameter for each decoded subband and making decoded spectral subband sharper if judged not sharp enough; making decoded spectral subband flatter or noisier if judged not flat or noisy enough; and normalizing the energy level of each modified subband to keep the energy level almost unchanged.

As already described, the spectral sharpness parameter representing spectral harmonic/noise sharpness of each subband is estimated by calculating the magnitude ratio of an average magnitude to the maximum magnitude, or by calculating the energy level ratio of an average energy level to the maximum energy level. If a plurality of spectral sharpness parameters are estimated on a plurality of subbands, one spectral sharpness parameter estimated from the sharpest spectral subband can be chosen to represent the spectral sharpness of the plurality of subbands when the number of bits to transmit the spectral sharpness information is limited. Each main sharpness control parameter for each decoded subband is formed by analyzing the differences between the corresponding transmitted spectral sharpness parameter(s) and the corresponding spectral sharpness parameter(s) measured from decoded subbands. Each main sharpness control parameter for each decoded subband can be smoothened between current subbands and/or between consecutive frames.

Making a decoded spectral subband sharper is realized by reducing the energy levels of frequency coefficients between harmonic peaks, increasing the energy levels of harmonic peaks, and/or reducing the noise component. Making decoded spectral subband flatter or noisier is realized by increasing the energy levels of frequency coefficients between harmonic peaks, reducing the energy levels of harmonic peaks, and/or increasing the noise component.

Additional embodiments will now be described.

If the decoded subbands already have reasonably good quality, the reference spectral sharpness information may not be necessarily transmitted from encoder to decoder. The spectral sharpness of decoded subbands may still be improved by doing actually post spectral sharpness control. The post spectral sharpness control is also based on the measured spectral sharpness parameter as defined in equation (17) for each subband instead of periodicity measuring. The measured spectral sharpness parameter can be smoothened between current subbands and/or between consecutive frames to form main sharpness control parameter for each decoded subband. If the main sharpness control parameter indicates that one subband is a sharp subband, it can be made sharper in a way described in the previous paragraph. In other words, the sharper the decoded subband is, the sharper the decoded subband is. This idea is somehow similar to the pitch-post-processing concept used for CELP codec in G.729.1, in which decoded periodic signal is made more periodic.

From the above-description, a method of controlling spectral harmonic/noise sharpness of decoded subbands is provided. The method comprises the steps of estimating the spectral sharpness parameter of each decoded subband at decoder side; forming the main sharpness control parameter for each decoded subband; analyzing the main sharpness control parameter for each decoded subband and making decoded spectral subband sharper if it is determined as being not sharp enough; and normalizing the energy level of each modified subband to keep the energy level almost unchanged. Each main sharpness control parameter for each decoded subband is formed by smoothing measured spectral sharpness parameters of decoded subbands between current subbands and/or between consecutive frames. Decoded subband showing sharper spectrum is made sharper than other decoded subbands in terms of comparing the main sharpness control parameters of decoded subbands.

Spectral sharpness related embodiments will now be described.

In the above-described embodiments, spectral sharpness is controlled by modifying related subbands at the decoder side. It is known that harmonic subband is perceptually more important than noisy subband if they have similar energy levels. Perceptual quality can be improved by allocating more bits to code harmonic subbands rather than noisy subbands. The spectral sharpness measuring of one subband can help to tell the corresponding subband is harmonic-like or noise-like. The embodiment includes the following points:

If spectral fine structure is coded rather than generated, a traditional bit allocation rule is only based on weighted subband energy levels as done in G.729.1, which is described by spectral envelope or spectral energy level distribution. It means more bits will be used in relatively higher energy subbands. Actually, if some subbands are harmonic-like and some subbands are noise-like, the harmonic area should be allocated more bits or paid more attention than noise-like area. This can be proven in CELP coder where only random noise is used as excitation for unvoiced speech and the perceptual quality is still good.

Perceptually, subbands with stronger harmonics (sharper spectrum) should be assigned with more bits than noisy subbands (less harmonic subbands) if the energy levels from different subbands have no big difference. In other words, in addition to the energy factor, the spectral sharpness should be also considered as one of the important factors to determine bit allocation to different subbands. The sharpness measuring parameter as discussed above can help to achieve the goal.

From the above description, a method of influencing the bit allocation to different subbands is provided. The method comprises the steps of estimating spectral sharpness parameter of each subband; comparing the values of spectral sharpness parameters from different subbands; and favoring the allocation of more bits or extra bits for coding the subband that shows a sharper spectrum than other subbands showing less sharp or flatter spectrum according to the comparison of estimated spectral sharpness parameters. If the total bit budget is fixed and the sharper subbands get more bits, flatter subbands must get less bits. The bit allocation to different subbands is usually based on the importance order of the related subbands, instead of relying only on spectral energy level distribution. The importance order may be determined according to both spectral sharpness distribution and spectral energy level distribution of the related subbands.

Figure 6:
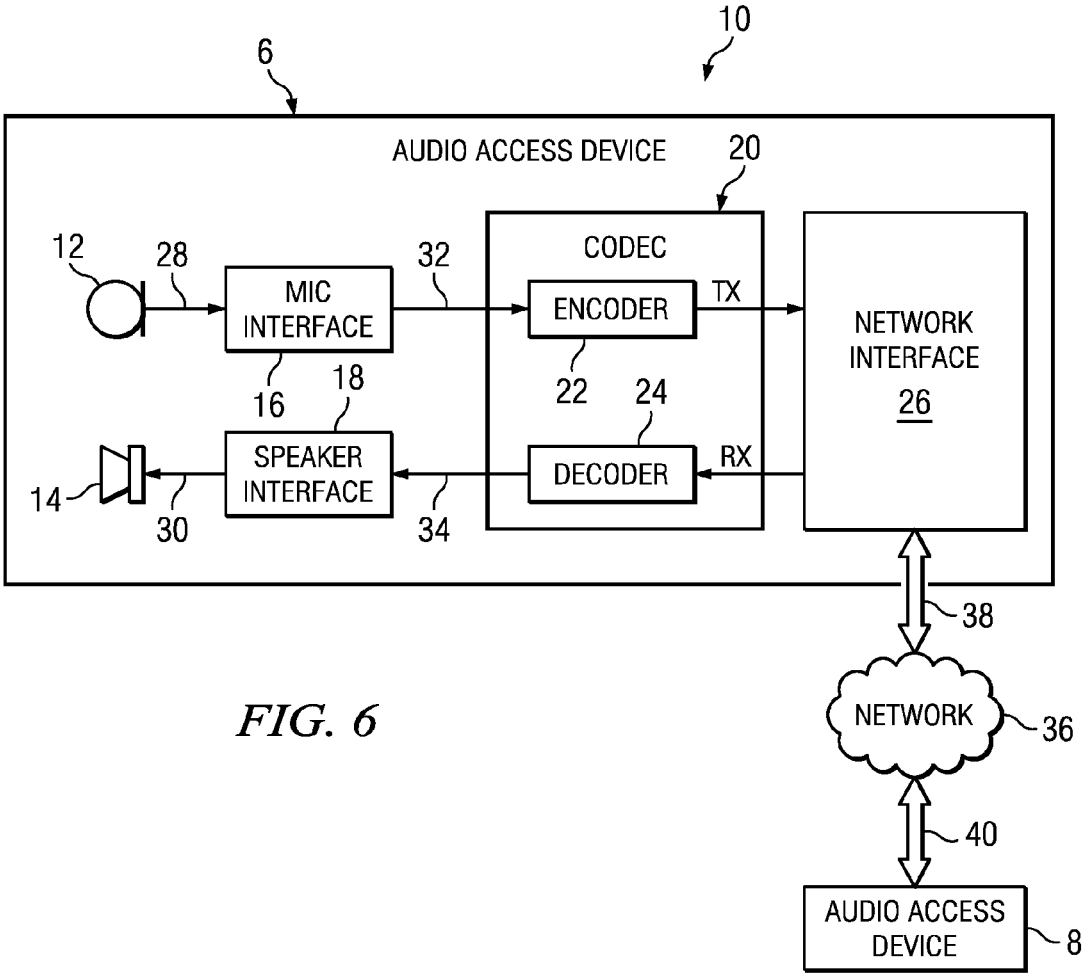
FIG. 6 illustrates a communication system according to an embodiment of the present invention.

FIG. 6 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PTSN) and/or the internet. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In embodiments of the present invention, where audio access device 6 is a VOIP device, some or all of the components within audio access device 6 are implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

The above description contains specific information pertaining to the spectral sharpness control. However, one skilled in the art will recognize that the present invention may be practiced in conjunction with various encoding/decoding algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain brevity, other embodiments of the invention which use the principles of the present invention are not specifically described in the present application and are not specifically illustrated by the present drawings.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of receiving an encoded audio signal comprising audio data and a transmitted spectral sharpness parameter representing a spectral harmonic/noise sharpness of a plurality of spectral subbands, wherein the transmitted spectral sharpness parameter is estimated in an encoder by calculating a magnitude ratio between an average magnitude and a maximum magnitude of an original spectral subband or an energy level ratio between an average energy level and a maximum energy level of an original spectral subband, and the transmitted spectral sharpness parameter is quantized in the encoder and sent to a decoder in which it is used to control spectral sharpness of decoded spectral subbands, the method comprising:

receiving the encoded audio signal;

decoding subbands from the audio data;

estimating a measured spectral sharpness parameter from the received audio data, wherein the measured spectral sharpness parameter is estimated in the decoder by calculating a magnitude ratio between an average magnitude and a maximum magnitude of a decoded spectral subband or an energy level ratio between an average energy level and a maximum energy level of a decoded spectral subband;

comparing the transmitted spectral sharpness parameter with the measured spectral sharpness parameter;

forming a main sharpness control parameter for each of the decoded subbands, wherein the main sharpness control parameter for each decoded subband is formed by analyzing differences between the corresponding transmitted spectral sharpness parameter and the measured spectral sharpness parameter;

analyzing the main sharpness control parameter for each of the decoded subbands;

sharpening ones of the decoded subbands if the corresponding main sharpness control judges that a corresponding subband is not sharp enough based on a result of comparing the main sharpness control parameters of decoded subbands, wherein sharpened subbands are formed by reducing energy of frequency coefficients between harmonic peaks, increasing energy of the harmonic peaks, and/or reducing noise component;

flattening ones of the decoded subbands if the corresponding main sharpness control judges that a corresponding subband is not flat enough based on a result of comparing the main sharpness control parameters of decoded subbands, wherein flattened subbands are formed by increasing energy of frequency coefficients between harmonic peaks, reducing energy of the harmonic peaks, and/or increasing noise component; and normalizing an energy level of each sharpened subband and each flattened subband to keep an energy level of each sharpened and/or flattened subband substantially unchanged.

2. The method of claim 1, further comprising transmitting a single spectral sharpness parameter estimated from a sharpest spectral subband if a number of bits to transmit spectral sharpness information is limited.

3. The method of claim 1, further comprising converting the sharpened and flattened subbands into an output audio signal.

4. The method of claim 3, further comprising driving a loudspeaker with the output audio signal.

5. The method of claim 1, wherein receiving comprises receiving over a voice over internet protocol (VOIP) network.

6. The method of claim 1, wherein receiving comprises receiving over a cellular telephone network.

7. A method of receiving an encoded audio signal, the method comprising:

receiving an encoded audio signal bitstream;

decoding subbands from the encoded audio signal bitstream;

estimating a measured spectral sharpness parameter from the encoded audio signal for each of the decoded subbands, wherein the measured spectral sharpness parameter represents a spectral harmonic/noise sharpness of the decoded subbands, and the measured spectral sharpness parameter is estimated in the decoder by calculating a magnitude ratio between an average magnitude and a maximum magnitude of a decoded spectral subband or an energy level ratio between an average energy level and a maximum energy level of a decoded spectral subband;

forming a main sharpness control parameter for each of the decoded subbands, wherein the main sharpness control parameter for each decoded subband is formed by analyzing the measured spectral sharpness parameter from decoded subbands;

sharpening ones of the decoded subbands if the corresponding main sharpness control judges that a corresponding subband is not sharp enough based on a result of comparing the main sharpness control parameters of decoded subbands, wherein sharpened subbands are formed by reducing energy of frequency coefficients between harmonic peaks, increasing energy of the harmonic peaks, and/or reducing noise component;

flattening ones of the decoded subbands if the corresponding main sharpness control judges that a corresponding subband is not flat enough based on a result of comparing the main sharpness control parameters of decoded subbands, wherein flattened subbands are formed by increasing energy of frequency coefficients between harmonic peaks, reducing energy of the harmonic peaks, and/or increasing noise component; and normalizing an energy level of each sharpened subband and each flattened subband to keep an energy level of each sharpened and/or flattened substantially unchanged.

8. The method of claim 7, further comprising smoothing each main sharpness control parameter for each decoded subband between current subbands and/or between consecutive frames.

9. The method of claim 7, wherein sharpening further comprises: comparing the main sharpness control parameters of the decoded subbands; and sharpening ones of the decoded subbands if the corresponding main sharpness control parameters indicate that a corresponding subband is sharper than other decoded subbands based on the comparing.

10. A method of transmitting an input audio signal, the method comprising:

estimating a spectral sharpness parameter of each subband of the input audio signal, wherein the spectral sharpness parameter represents a spectral harmonic/noise sharpness of each subband of the input audio signal, wherein the spectral sharpness parameter is estimated in an encoder by calculating a magnitude ratio between an average magnitude and a maximum magnitude of an original spectral subband or an energy level ratio between an average energy level and a maximum energy level of an original spectral subband;

comparing the estimated spectral sharpness parameters from different subbands;

allocating more bits to subbands having a sharper spectrum based on the comparing;

allocating less bits to subbands having a flatter spectrum based on the comparing; and transmitting the allocated bits.

11. The method of claim 10, wherein bits are further allocated to subbands according to energy level distribution of the subbands.

12. The method of claim 10, wherein bits allocated to subbands having a flatter spectrum are further reduced if a total bit budget is fixed.

13. A system for receiving an encoded audio signal, the system comprising:

a receiver configured to receive the encoded audio signal, the receiver configured to:

decode subbands from the encoded audio signal;

estimate a measured spectral sharpness parameter from the encoded audio signal for each of the decoded subbands, wherein the spectral sharpness parameter represents a spectral harmonic/noise sharpness of each decoded subband, wherein the measured spectral sharpness parameter is estimated in the decoder by calculating a magnitude ratio between an average magnitude and a maximum magnitude of a decoded spectral subband or an energy level ratio between an average energy level and a maximum energy level of a decoded spectral subband;

form a main sharpness control parameter for each of the decoded subbands, wherein the main sharpness control parameter for each decoded subband is formed by analyzing the measured spectral sharpness parameter from the decoded subbands;

sharpen ones of the decoded subbands if the corresponding main sharpness control judges that a corresponding subband is not sharp enough based on a result of comparing the main sharpness control parameters of decoded subbands, wherein sharpened subbands are formed by reducing energy of frequency coefficients between harmonic peaks, increasing energy of the harmonic peaks, and/or reducing noise component;

flatten ones of the decoded subbands if the corresponding main sharpness control judges that a corresponding subband is not flat enough based on a result of comparing the main sharpness control parameters of decoded subbands, wherein flattened subbands are formed by increasing energy of frequency coefficients between harmonic peaks, reducing energy of the harmonic peaks, and/or increasing noise component; and normalize an energy level of each sharpened subband and each flattened subband to keep an energy level of each sharpened and/or flattened substantially unchanged.

14. The system of claim 13, wherein the receiver is further configured to convert the sharpened and flattened subbands into an output audio signal.

15. The system of claim 14, wherein the output audio signal is configured to drive a loudspeaker.

16. The system of claim 13, wherein the system is configured to operate over a voice over internet protocol (VOIP) system.

17. The system of claim 13, wherein the system is configured to operate over a cellular telephone network.

* * * * *